US009741199B2

(12) United States Patent
Burke

(10) Patent No.: US 9,741,199 B2
(45) **Date of Patent: *Aug. 22, 2017**

(54) WAGERING GAME SYSTEM MANAGER

(71) Applicant: WMS Gaming, Inc., Waukegan, IL (US)

(72) Inventor: Mary M. Burke, Somonauk, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/740,094

(22) Filed: Jun. 15, 2015

(65) Prior Publication Data

US 2015/0279153 A1 Oct. 1, 2015

Related U.S. Application Data

(63) Continuation of application No. 12/447,173, filed as application No. PCT/US2007/082211 on Oct. 23, 2007, now Pat. No. 9,058,721.

(60) Provisional application No. 60/862,691, filed on Oct. 24, 2006.

(51) Int. Cl.
*G07F 17/32* (2006.01)
*G06Q 50/34* (2012.01)

(52) U.S. Cl.
CPC ..... *G07F 17/3211* (2013.01); *G06Q 50/34* (2013.01); *G07F 17/3234* (2013.01); *G07F 17/3244* (2013.01)

(58) Field of Classification Search
USPC ..... 463/42
See application file for complete search history.

(56) References Cited

U.S. PATENT DOCUMENTS

| | | | | |
|---|---|---|---|---|
| 5,655,961 | A * | 8/1997 | Acres et al. | 463/27 |
| 9,058,721 | B2 | 6/2015 | Burke | |
| 2003/0130039 | A1 | 7/2003 | Nelson | |
| 2005/0159204 | A1* | 7/2005 | Moshal | 463/17 |
| 2006/0217202 | A1* | 9/2006 | Burke et al. | 463/42 |

(Continued)

FOREIGN PATENT DOCUMENTS

| | |
|---|---|
| WO PCT/US2006/028250 | 1/2007 |
| WO PCT/US2006/028168 | 2/2007 |

OTHER PUBLICATIONS

"PCT Application No. PCT/US2007/082211 International Search Report", Oct. 2, 2008, 6 pages.

(Continued)

*Primary Examiner* — Yu-Hsi D Sun
(74) *Attorney, Agent, or Firm* — DeLizio Law, PLLC

(57) ABSTRACT

Embodiments of a wagering game system manager are described herein. In one embodiment, a wagering game system includes a plurality of wagering game machines. The wagering game system can also include a plurality of wagering game managers, wherein each of the wagering game managers is configured to acquire a different set of manufacturer-specific wagering game information from ones of the wagering game machines. Additionally, the wagering game system can include a multi-system manager configured to generate an interface including a plurality of views, each view to presents one of the different sets of manufacturer-specific wagering game information.

19 Claims, 12 Drawing Sheets

(56) References Cited

U.S. PATENT DOCUMENTS

2010/0093440 A1 4/2010 Burke

OTHER PUBLICATIONS

"PCT Application U.S. Appl. No. PCT/US20071082211 International Preliminary Report on Patentability", Apr. 30, 2009, 7 pages.
"U.S. Appl. No. 12/447,173 Final Office Action", Feb. 13, 2012, 12 pages.
"U.S. Appl. No. 12/447,173 Office Action", Sep. 26, 2011, 13 pages.
U.S. Appl. No. 11/277,064, filed Mar. 21, 2006, 40 Pages.
U.S. Appl. No. 11/279,489, filed Nov. 12, 2006, 46 Pages.

* cited by examiner

WAGERING GAME SYSTEM MANAGER

RELATED APPLICATIONS

This application is a continuation application that claims priority benefit of U.S. application Ser. No. 12/447,173 which is a National Stage Application of PCT/US2007/082211 filed 23 Oct. 2007, which claims priority benefit of Provisional U.S. Application No. 60/862,691 filed 24 Oct. 2006.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming Inc.

FIELD

Embodiments of the inventive subject matter relate generally to wagering game systems, and more particularly, to processing wagering-game-related data from disparate wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

The present invention is illustrated by way of example and not limitation in the Figures of the accompanying drawings in which.

DESCRIPTION OF THE EMBODIMENTS

This description of the embodiments is divided into five sections. The first section provides an introduction to embodiments of the invention, while the second section describes example wagering game system architectures. The third section describes example operations performed by some embodiments and the fourth section describes example wagering game machines in more detail. The fifth section presents some general comments.

Introduction

This section provides an introduction to some embodiments of the invention.

Figure 1:
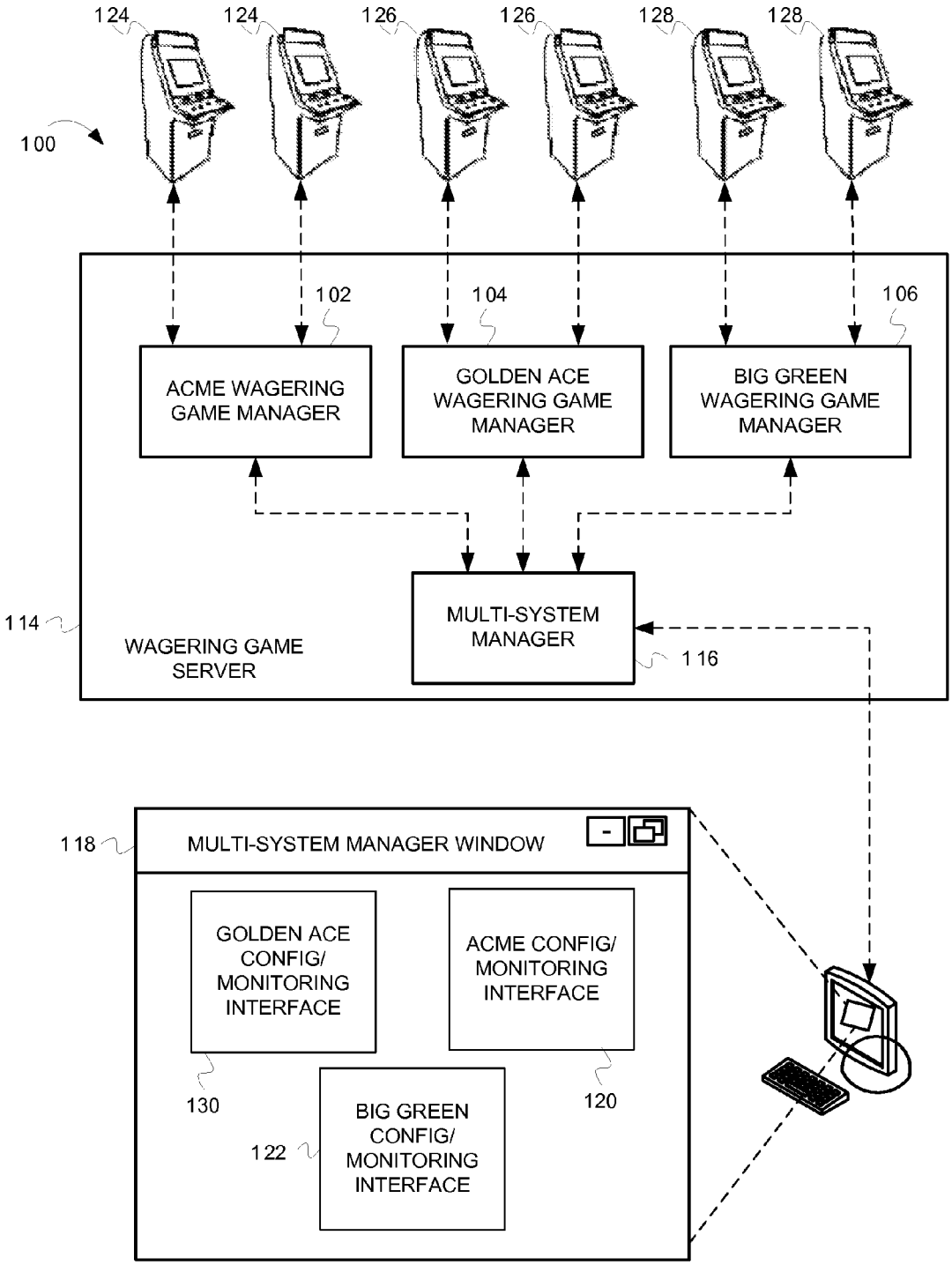
FIG. 1 is a dataflow diagram illustrating how a wagering game manager can enable casino administrators to configure wagering game machines that have different manufacturer-specific features, according to example embodiments of the invention.

Many wagering game machine manufacturers offer management systems that enable casino administrators to remotely monitor and configure wagering game machines. However, some management systems do not recognize manufacturer-specific/nonstandard features available in some wagering game machines. As a result, casino administrators often use several different management systems to manage wagering game machines made by different manufacturers. Using several different management systems can be cumbersome because each management system may require different computers or different computer configurations. Also, running several different management systems may clutter desktops and slow-down system operations. Some embodiments of the invention enable casino administrators to use a single interface to manage machines that have different manufacturer-specific/nonstandard features. FIG. 1 introduces some of these embodiments.

FIG. 1 is a dataflow diagram illustrating how a wagering game manager can enable casino administrators to configure wagering game machines that have different manufacturer-specific features, according to example embodiments of the invention. In FIG. 1, the management system 100 includes a wagering game server 114, which includes a multi-system manager 116. The multi-system manager 116 can launch a plurality of different wagering game managers, where each different wagering game manager can monitor and configure wagering game machines that have different manufacturer-specific features. For example, in FIG. 1, the multi-system manager 116 can launch the Acme wagering game manager 102, Golden Ace wagering game manger 104, and Big Green wagering game manager 106. The multi-system manager 116 can use the Acme wagering game manager 102 to configure Acme-specific features on the Acme wagering game machines 124. Similarly, the multi-system manager 116 can use the Golden Ace wagering game manager 104 to configure Golden-Ace-specific features on the Golden Ace machines 126, and so on. The different wagering game managers 102, 104, & 106 can run in the background, while the multi-system manager 116 can interact with users (e.g., casino administrators). The multi-system manager 116 can present an interface 118 that includes a Golden Ace configuration/monitoring area 130, Big Green configuration/monitoring area 122, and an Acme configuration/monitoring area 120. The areas 130, 122, & 120 enable casino administrators to configure and monitor different manufacturer-specific features of the wagering game machines 124, 126, and 128 through a single user interface.

Wagering Game System Architectures

This section presents an example wagering game network architecture, multi-system manager architecture, and wagering game machine architecture.

Wagering Game Network Architecture

Figure 2:
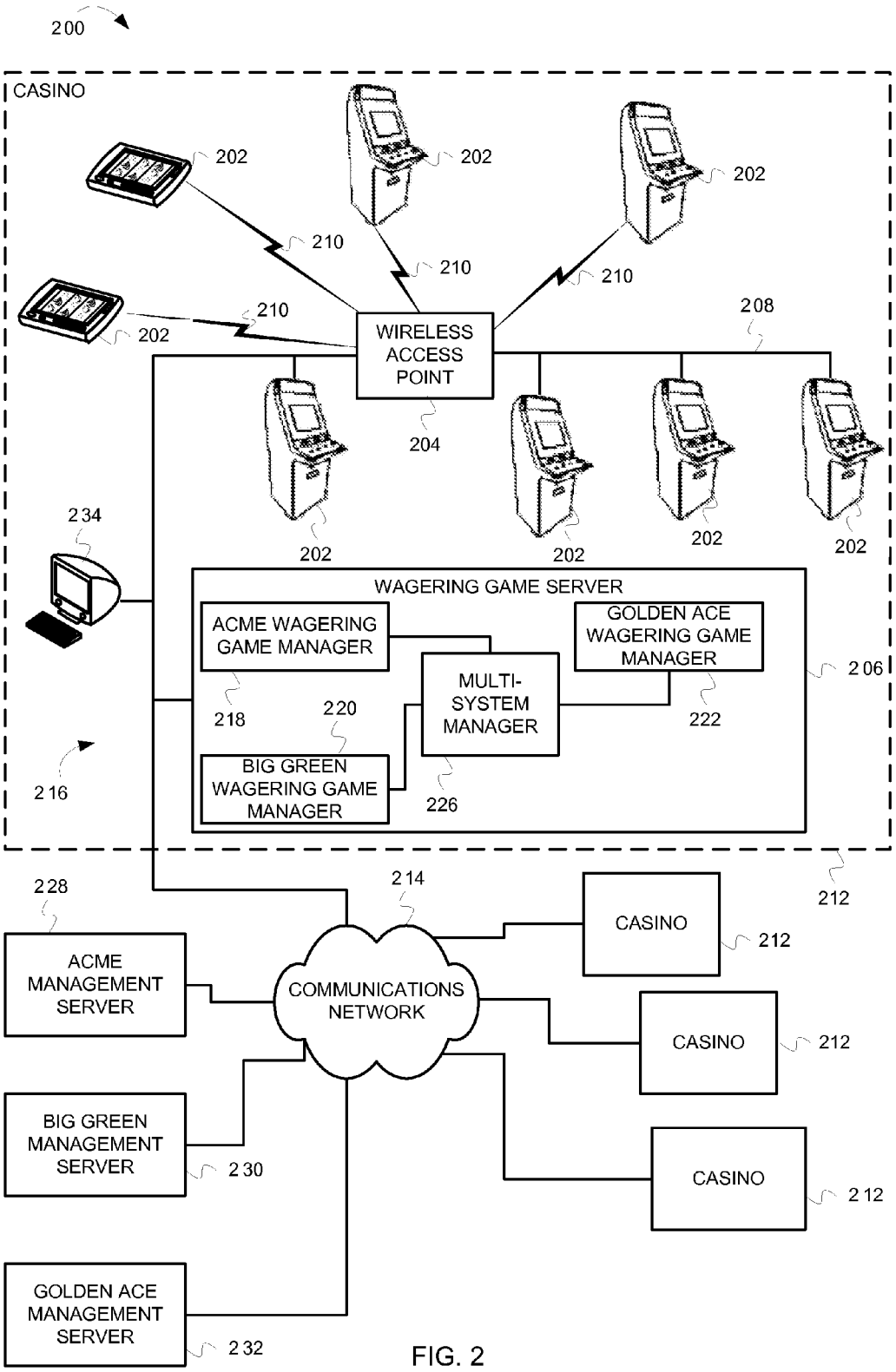
FIG. 2 is a block diagram illustrating a wagering game network, according to example embodiments of the invention.

FIG. 2 is a block diagram illustrating a wagering game network, according to example embodiments of the invention. As shown in FIG. 2, the wagering game network 200 includes a plurality of casinos 212 connected to a communications network 214.

Each of the plurality of casinos 212 includes a local area network 216, which includes a wireless access point 204, wagering game machines 202, and a wagering game server 206. The wagering game server 206 can serve wagering games to the wagering game machines 202 via the local area network 216. The wagering game server 206 includes a plurality of wagering game managers, including the Acme wagering game manager 218, Big Green wagering game manager 220, and Golden Ace wagering game manger 222. In some embodiments, each wagering game manager 218, 220, & 222 can configure and monitor a set of the wagering game machines 202, where the set of machines has manufacturer-specific and/or nonstandard features. For example, the Acme wagering game manager 220 can configure and monitor those of the wagering game machines 202 that support Acme-specific features. In some embodiments, the wagering game managers 218, 220, & 222 can include a plurality of software application programs, where each application program provides different features. The wagering game managers 218, 220, & 222 can operate in full-scale mode, where they provide a user interface and other features. However, they can also operate in a scaled-down mode in which they only process requests from the multi-system manager 226.

The multi-system manager 226 can itself access/configure standard information in the wagering game machines 202 (e.g., using standard protocols, such as G2E), while it can use the wagering game managers 218, 220, & 222 to access manufacturer-specific and/or nonstandard features. Some embodiments of the multi-system manager 226 provide an interface though which casino administrators can configure and monitor manufacturer-specific features of all the wagering game machines 202. The multi-system manager can present the interface on the administrator terminal 234. Although FIG. 2 shows the wagering game wagering game managers 218, 220, & 222 inside the wagering game server 206, they can be located in other computers (not shown) on the local area network 216 or communications network 214.

The local area network 216 includes wireless communication links 210 and wired communication links 208. The wired and wireless communication links can employ any suitable connection technology, such as Bluetooth®, 802.11, Ethernet, public switched telephone networks, SONET, etc.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, player tracking servers, and/or other devices suitable for use in connection with embodiments of the invention. The wagering game machines 202 and any other component of the wagering game network 200 can include hardware and machine-readable media including instructions for performing the operations described herein.

The communications network 214 is also connected to a plurality of management servers 228, 230, & 232. In some embodiments, the management servers 228, 230, & 232 can work with the wagering game managers 218, 220, & 222 to monitor and configure the wagering game machines 202. For example, the Acme management server 228 can transmit configuration information to the Acme wagering game manager 218. Also, the Acme management server 228 can store information collected about wagering game machines 202 that include Acme-specific features. The other management servers 230 & 232 can perform similar operations. In some embodiments, the wagering game managers 218, 220, & 222 do not operate in conjunction with the management servers 228, 230, and 232.

Multi-System Manager

Figure 3:
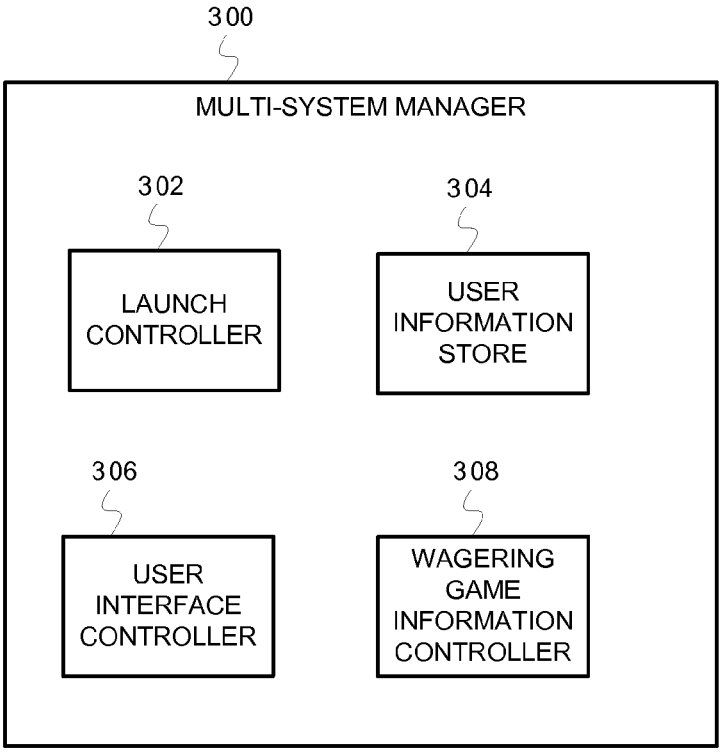
FIG. 3 is a block diagram illustrating a multi-system manager, according to example embodiments of the invention.

FIG. 3 is a block diagram illustrating a multi-system manager, according to example embodiments of the invention. As shown, the multi-system manager 300 includes user interface controller 306, launch controller 302, user information store 304, and wagering game information controller 308.

In some embodiments, the user interface controller 306 can receive user input and present information via a graphical user interface, such as a window or the like. In some embodiments, the launch controller 302 can launch wagering game managers for use in configuring and monitoring manufacturer-specific features in wagering game machines.

In some embodiments, the user information store 304 can store user preferences, such as interface layout and content preferences, wagering game manager preferences, and any other suitable information indicating user-selectable features. In some embodiments, the wagering game information controller 308 can consolidate information acquired from a plurality of wagering game managers. For example, the wagering game information controller 308 can consolidate information acquired from the Acme, Big Green, and Golden Ace managers. Additionally, the wagering game information controller 308 can use standard protocols to collect some types of wagering game information from wagering game machines made by different manufacturers. For example, the wagering game information controller 308 can use the G2S protocol to acquire coin-in information from Acme and Golden Ace machines.

The "Operations" section (see below) will describe operations performed by embodiments of the multi-system manager.

Wagering Game Machine Architecture

Figure 4:
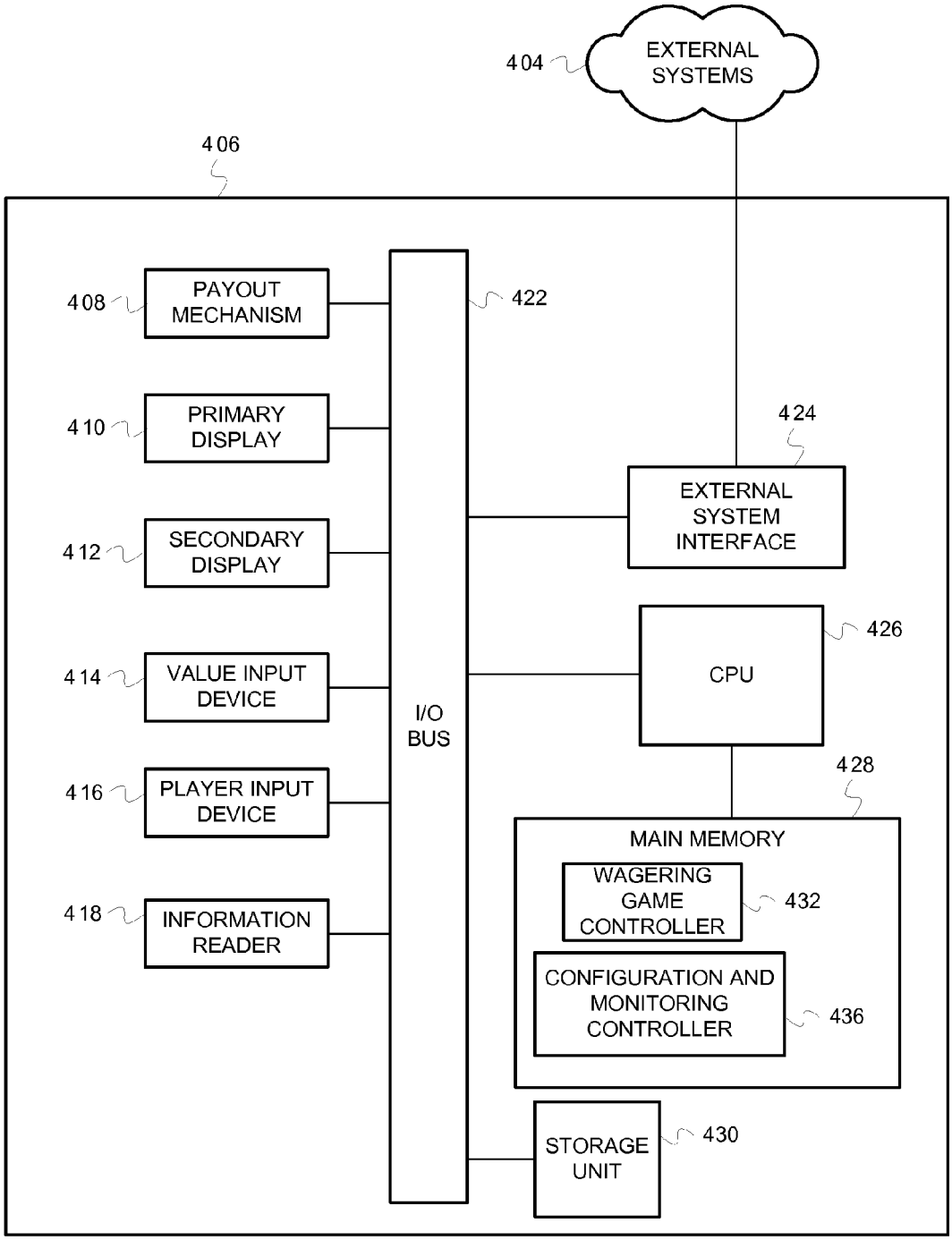
FIG. 4 is a block diagram illustrating a wagering game machine architecture, according to example embodiments of the invention.

FIG. 4 is a block diagram illustrating a wagering game machine architecture, according to example embodiments of the invention. As shown in FIG. 4, the wagering game machine 406 includes a central processing unit (CPU) 426 connected to main memory 428. The CPU 426 can include any suitable processor, such as an Intel® Pentium processor, Intel® Core 2 Duo processor, AMD Opteron™ processor, or UltraSPARC processor. The main memory 428 includes a wagering game controller 432 and a configuration and monitoring controller 436. In one embodiment, the wagering game presentation unit 432 can present wagering games, such as video poker, video black jack, video slots, video lottery, etc., in whole or part. In some embodiments, the configuration and monitoring controller 436 can interact with wagering game management systems (e.g., wagering game managers, management servers, or the like) to facilitate configuration and monitoring of manufacturer-specific features of the machine 406. In alternative embodiments, the configuration and monitoring controller 436 can be embodied as a device connected to the I/O bus 422.

The CPU 426 is connected to the input/output (I/O) bus 422, which can include any suitable bus technologies, such as an AGTL+ frontside bus and a PCI backside bus. The I/O bus 422 is connected to a payout mechanism 408, primary display 410, secondary display 412, value input device 414, player input device 416, information reader 418, and storage unit 430. The player input device 416 can include the value input device 414 to the extent the player input device 416 is used to place wagers. The I/O bus 422 is also connected to an external system interface 424, which is connected to external systems 404 (e.g., wagering game networks).

In one embodiment, the wagering game machine 406 can include additional peripheral devices and/or more than one of each component shown in FIG. 4. For example, in one embodiment, the wagering game machine 406 can include multiple external system interfaces 424 and/or multiple CPUs 426. In one embodiment, any of the components can be integrated or subdivided.

Any component of the wagering game machine 406 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Operations and Interfaces

This section describes operations and interfaces associated with embodiments of the invention. This section will begin by describing operations for initializing multi-system managers and it will continue with some example multi-system manager interfaces. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel.

Figure 5:
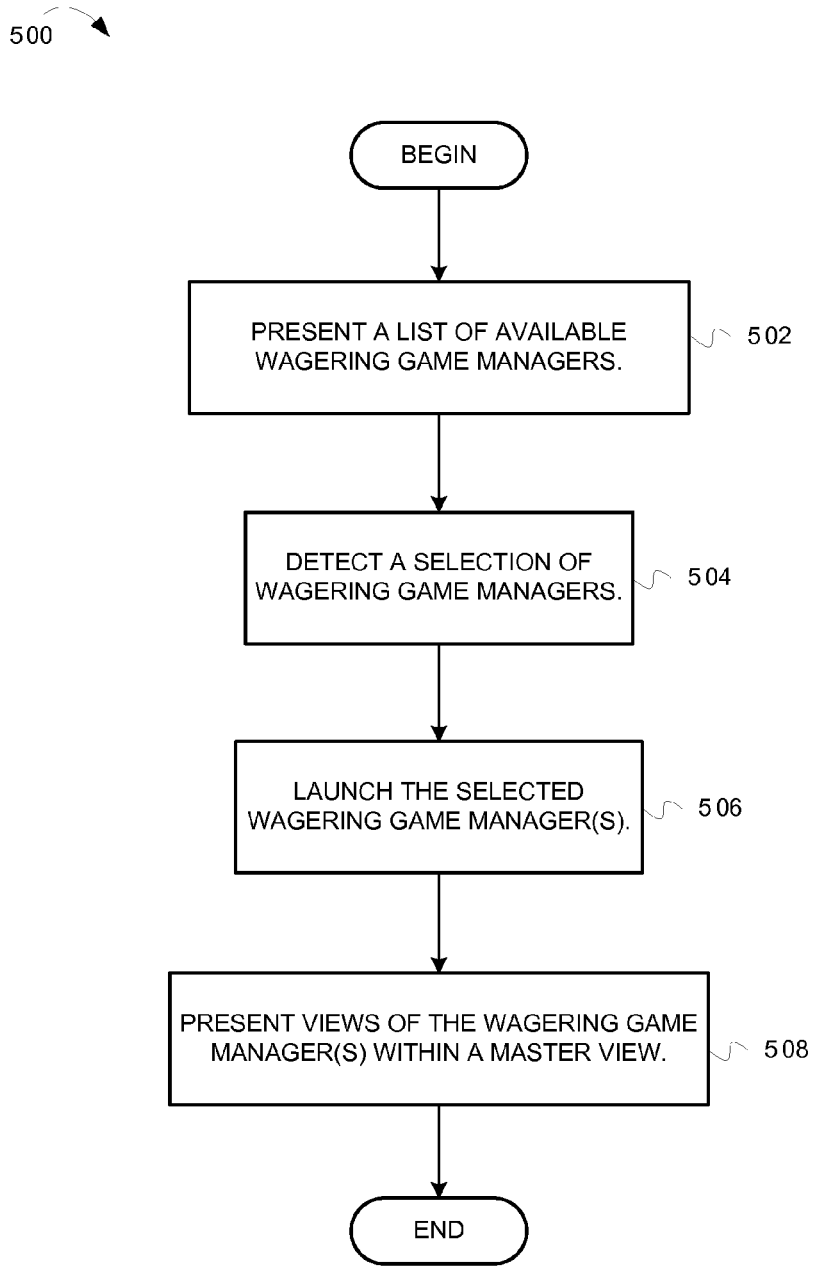
FIG. 5 is a flow diagram illustrating operations for initializing a multi-system manager, according to example embodiments of the invention.

FIG. 5 is a flow diagram illustrating operations for initializing a multi-system manager, according to example embodiments of the invention. The flow 500 will begin at block 502.

At block 502, the multi-system manager 226 presents a list of available wagering game managers. For example, in a graphical user interface window, the multi-system manager's user interface controller 306 presents a list indicating that the Acme wagering game manager 218, Big Green wagering game manager 220, and Golden Ace wagering game manager 222 are available on the wagering game server 206. The flow continues at block 504.

At block 504, the multi-system manager 226 detects a selection of one or more wagering game system managers. For example, the multi-system manager's user interface controller 306 detects user input (via a graphical user interface) indicating a casino administrator's selection of wagering game managers. Typically, casino administrators select particular wagering game managers because they want to monitor and/or configure manufacturer-specific features of certain wagering game machines. For example, a casino administrator could select the Acme wagering game manager 218 to utilize its ability to configure and monitor Acme wagering game machines. The casino administrator could select the Big Green and Golden Ace wagering game managers 220 & 222, in addition to selecting the Acme manager 218. The flow continues at block 506.

At block 506, the multi-system manager 226 launches the selected wagering game system manager(s). For example, the multi-system manager's launch controller 302 instantiates and executes the selected wagering game managers. In some embodiments, the wagering game system managers operate as separate application programs. In some embodiments, the launch controller 302 launches a scaled-down version of the wagering game managers (e.g., a version of the managers that does not include user interface components). The flow continues at block 508.

At block 508, the multi-system manager 226 presents a user interface that enables users to access all the monitoring and configuration functionality available in the selected wagering game managers. For example, through the multi-system manager's interface, a casino administrator can configure manufacturer-specific features on wagering game machines made by Acme, Big Green, and Golden Ace. From block 508, the flow ends.

Figure 6A:
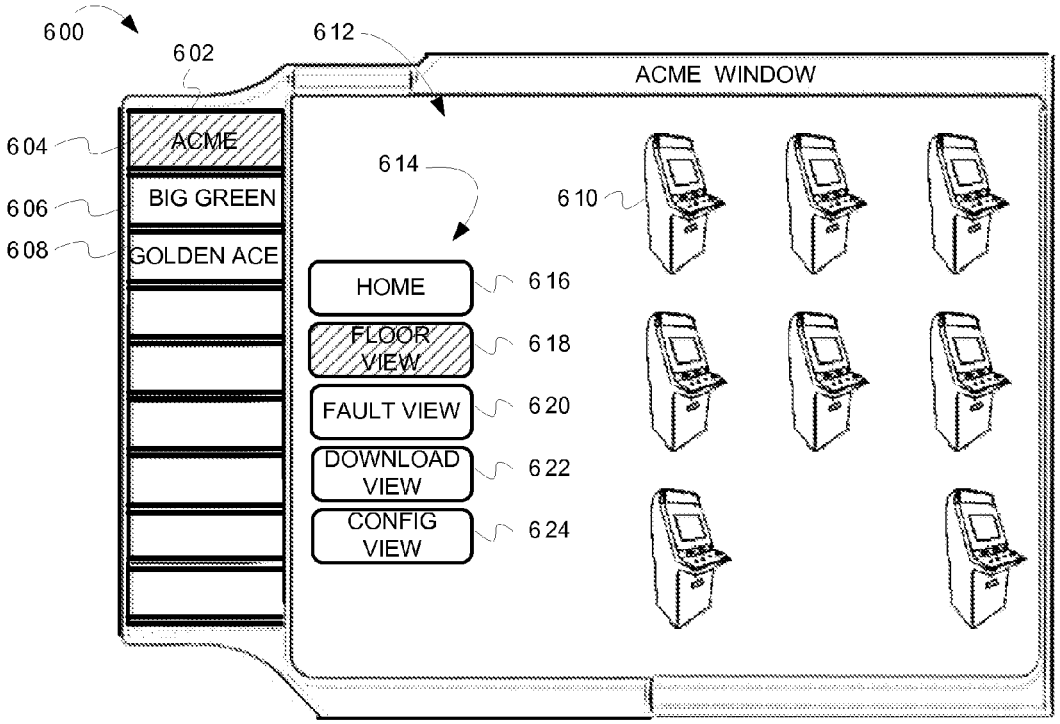
FIG. 6A is a diagrammatic illustration of a multi-system manager interface, according to example embodiments of the invention.
Figure 6B:
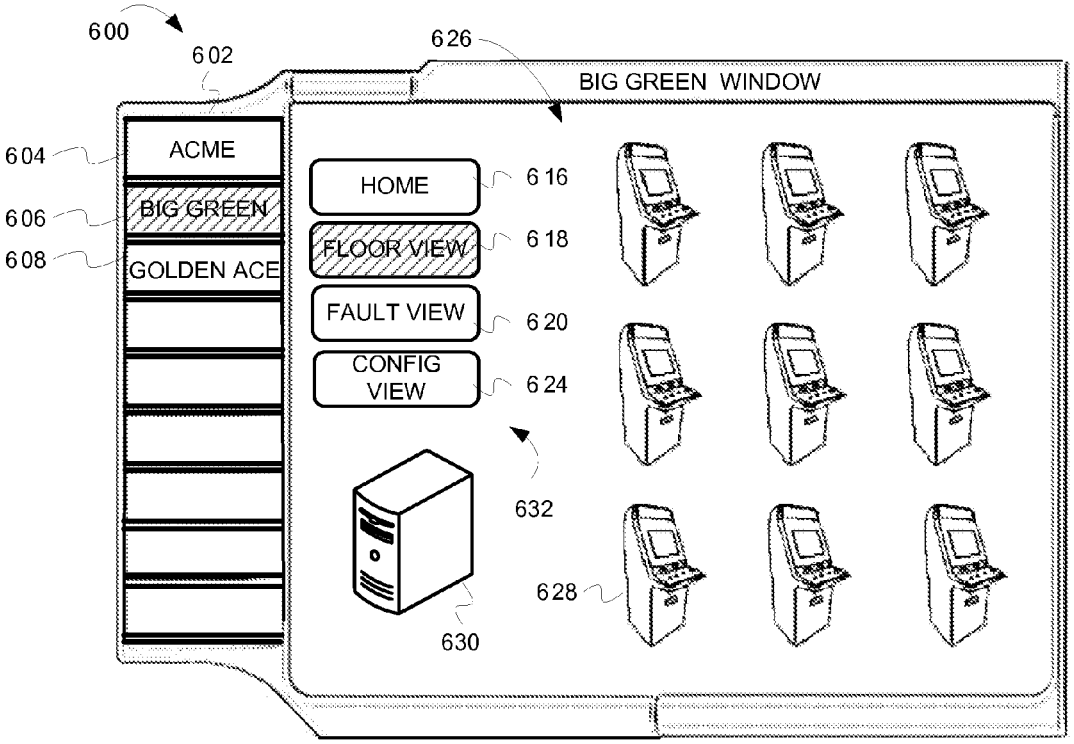
FIG. 6B is another diagrammatic illustration of a multi-system manager interface, according to example embodiments of the invention.

This section continues with a discussion of FIGS. 6A and 6B, which show embodiments of a multi-system manager's user interface.

FIG. 6A is a diagrammatic illustration of a multi-system manager interface, according to example embodiments of the invention. As noted above, embodiments of the multi-system manager can present an interface through which casino administrators can access configuration and monitoring functions of a plurality of wagering game managers. In FIG. 6A, the interface 600 includes a button panel 602. The button panel 602 includes an Acme button 604, Big Green button 606, and Golden Ace button 608. The buttons 604, 606, & 608 enable users to switch between different windows, where each window facilitates monitoring and/or configuration of different manufacturer-specific features. As show, after the Acme button 604 has been activated (see the diagonal marks on the Acme button 604), the multi-system manager 226 presents the Acme window 612.

The Acme window 612 includes a button panel 614 that enables users to select between different views supported by the Acme wagering game manager 218. Different wagering game mangers can support other views, such as accounting views, security views, performance views, etc. Any of the views can include information indicating configuration and status of the wagering game machines, themes on the wagering game machines, accounting statistics on the wagering game machines, etc.

The button panel 614 includes a home button 616, floor view button 618, fault view button 620, download view button 622, and configuration view button 624. In FIG. 6A, the floor view button 618 has been selected (see the diagonal marks on the floor view button). In some embodiments, the floor view shows a representation of a casino's wagering game machines made by a particular manufacturer. For example, in FIG. 6A, the floor view shows Acme wagering game machines 610, which include Acme-specific features. From the floor view, casino administrators can see that there are eight Acme wagering game machines on their casino floor.

When different buttons on the button panel 602 are activated, the interface 600 can switch between windows, providing access to different manufacturer-specific features. For example, an administrator could activate the Big Green button 606, which would cause the multi-system manager 226 to switch to a window associated with Big Green wagering game machines. FIG. 6B describes this in greater detail.

FIG. 6B is another diagrammatic illustration of a multi-system manager interface, according to example embodiments of the invention. In FIG. 6B, the interface 600 includes the button panel 602 and buttons 604, 606, & 608. The interface 600 also includes a Big Green window 626. The window 626 includes a button panel 632, which includes the home button 616, floor view button 618, fault view button 620, and the configuration button 624.

In FIG. 6B, the Big Green button 606 has been selected (see the diagonal marks on the Big Green button 606), so the multi-system manager 226 is showing the Big Green window 626. In contrast to the Acme window 612 (see FIG. 6A), the Big Green window 626 does not include a download button 622, as Big Green wagering game machines do not support download features.

In the Big Green window 626, the floor view button 618 has been selected (see diagonal marks on the floor view button 618). In the Big Green window 626, the floor view shows a representation of a casino's Big Green wagering game machines 628 and a wagering game server 630 associated with the machines 628.

While the interface 600 is configured to work with three wagering game managers (i.e., Acme, Big Green, and Golden Ace), embodiments of the multi-system manager 226 can work with any number of managers. As a result, the interface 600 can facilitate access to manufacturer-specific/nonstandard features associated with any number of wagering game system managers.

This section continues with another example of how embodiments of the multi-system manager interface can present manufacturer-specific information.

Figure 7:
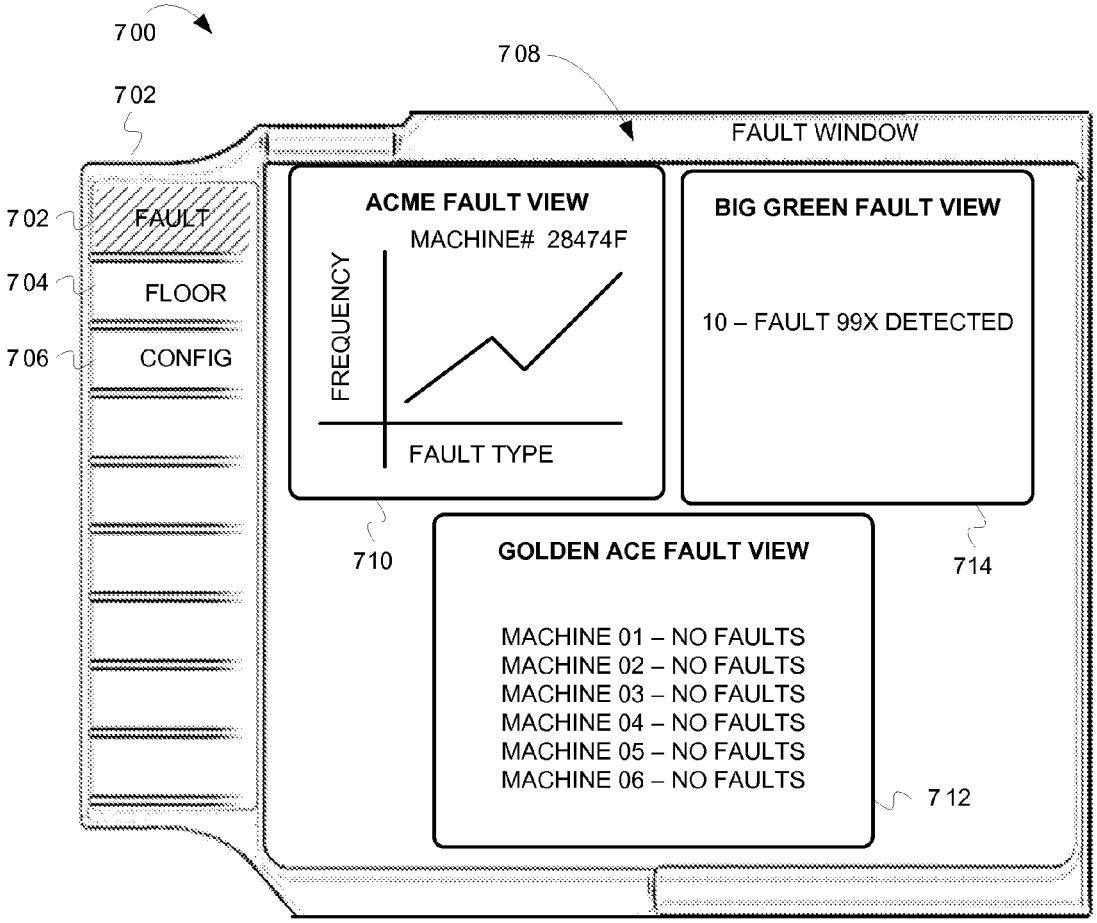
FIG. 7 is a diagrammatic illustration of a multi-system manager interface that can present manufacturer-specific information from a plurality of wagering game managers in one window, according to example embodiments of the invention.

FIG. 7 is a diagrammatic illustration of a multi-system manager interface that can present manufacturer-specific information from a plurality of wagering game managers in one window, according to example embodiments of the invention. The interface 700 is part of a multi-system manager 226 that has been configured to work with the wagering game machines 202, Acme wagering game manager 218, Golden Ace wagering game manager 222, and Big Green wagering game manager 220. In some embodiments, the multi-system manager 226 receives manufacturer-specific information from the managers 218, 220, & 222.

In FIG. 7, the multi-system manager interface 700 includes a button panel 702, which includes a fault button 702, floor button 704, and configuration button 706. Each of the buttons 702, 704, & 706 is associated with a different window, where each window presents manufacturer-specific wagering game machine information. As shown, the fault button 702 has been selected (see the diagonal marks on the fault button 702). Because the fault button 702 has been selected, the interface 700 is presenting a fault window 708.

The fault window 708 includes an Acme fault view 710, Big Green fault view 714, and Golden Ace fault view 712. Each of the fault views 710, 712, & 714 presents fault information about different wagering game machines in a casino. The fault information in each fault view is specific to wagering game machines made by a particular manufacturer. For example, the Acme fault view 710 presents nonstandard Acme-specific fault information that is particular to Acme wagering game machines in the casino. The fault information shown in the Acme fault view 710 differs from the fault information shown in the other fault views 712 & 714. In particular, the Acme fault view 710 shows fault information in graphical form. In contrast, the Big Green fault view 714 shows a Big-Green-specific wagering game machine identifier and fault code, while the Golden Ace fault view 712 shows Golden-Ace-specific fault information associated with all Golden Ace machines in the casino.

In some embodiments, each window may not include views for all the manufacturer-specific wagering game managers. For example, a configuration window (not shown) may not include a view for Big Green machines, as the Big Green wagering game manager 220 and Big Green wagering game machines may not support configuration features.

This section continues with a discussion about operations for configuring a multi-system manager's interface.

Figure 8:
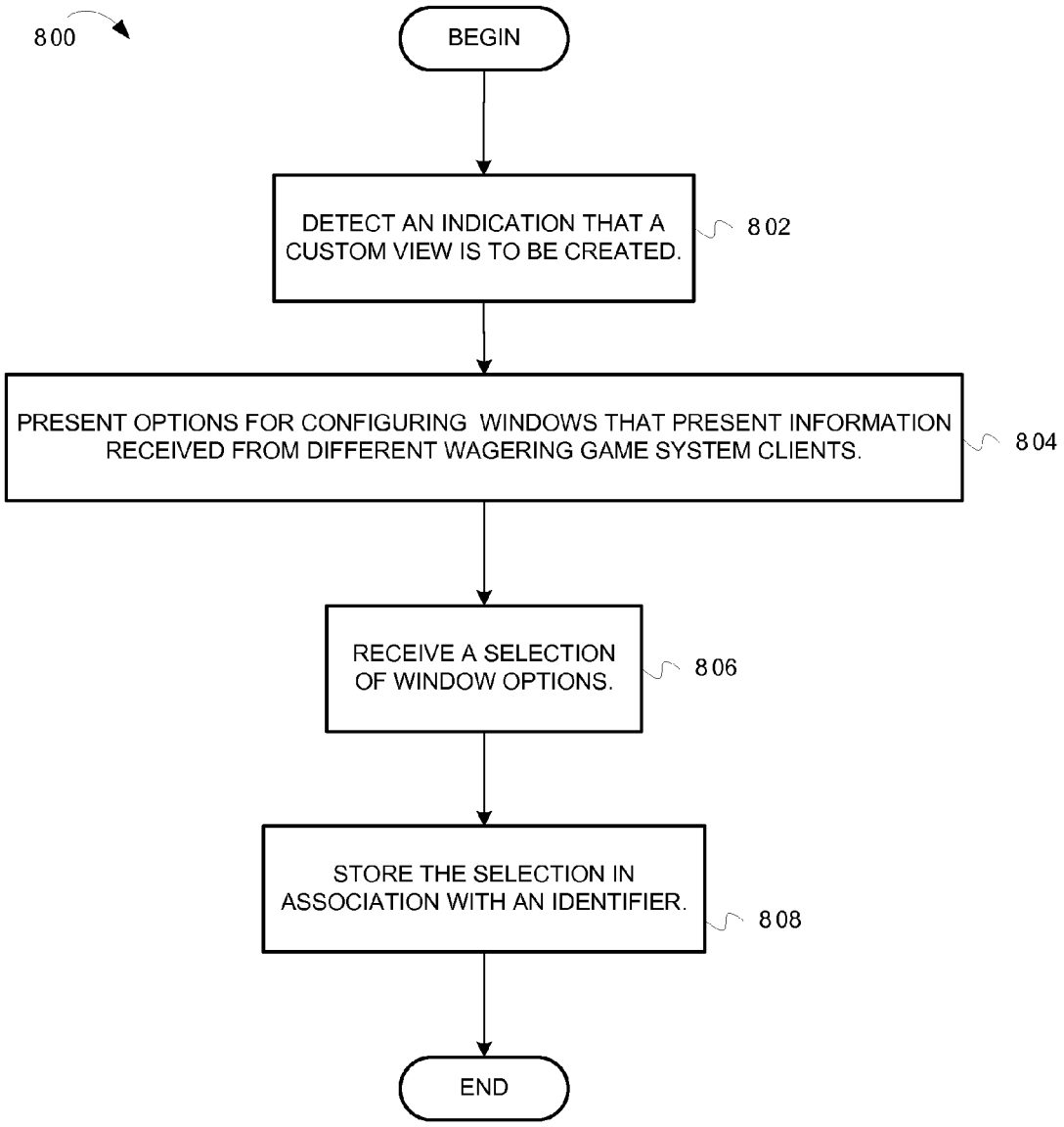
FIG. 8 is a flow diagram illustrating operations for configuring a multi-system manager interface, according to example embodiments of the invention.

FIG. 8 is a flow diagram illustrating operations for configuring a multi-system manager interface, according to example embodiments of the invention. The flow 800 begins at block 802.

At block 802, the multi-system manager's user interface controller 306 detects an indication that an interface is to be configured. For example, the user interface controller 306 detects that an administrator has selected interface configuration options in a graphical user interface (not shown). The flow continues at block 804.

At block 804, the user interface controller 306 presents options for configuring windows that present information received from different wagering game managers. The user interface controller 306 can present the options in a graphical user interface similar to that shown in FIG. 6. The options can include different views, colors, layouts, etc. In some embodiments, the options depend on the manufacturer-specific features supported by the wagering game managers and/or wagering game machines. For example, one fault view may have configuration options related to graphical data formats, while another fault view may not offer options for configuring graphical data. The flow continues at block 806.

At block 806, the user interface controller 306 receives option selections through a user interface. In some embodiments, the option selections indicate user-selected windows, views, colors, layouts, etc. The flow continues at block 808.

At block 808, the user interface controller 306 stores the option selections with a user identifier in the user information store 304. From block 808, the flow ends.

Figure 9:
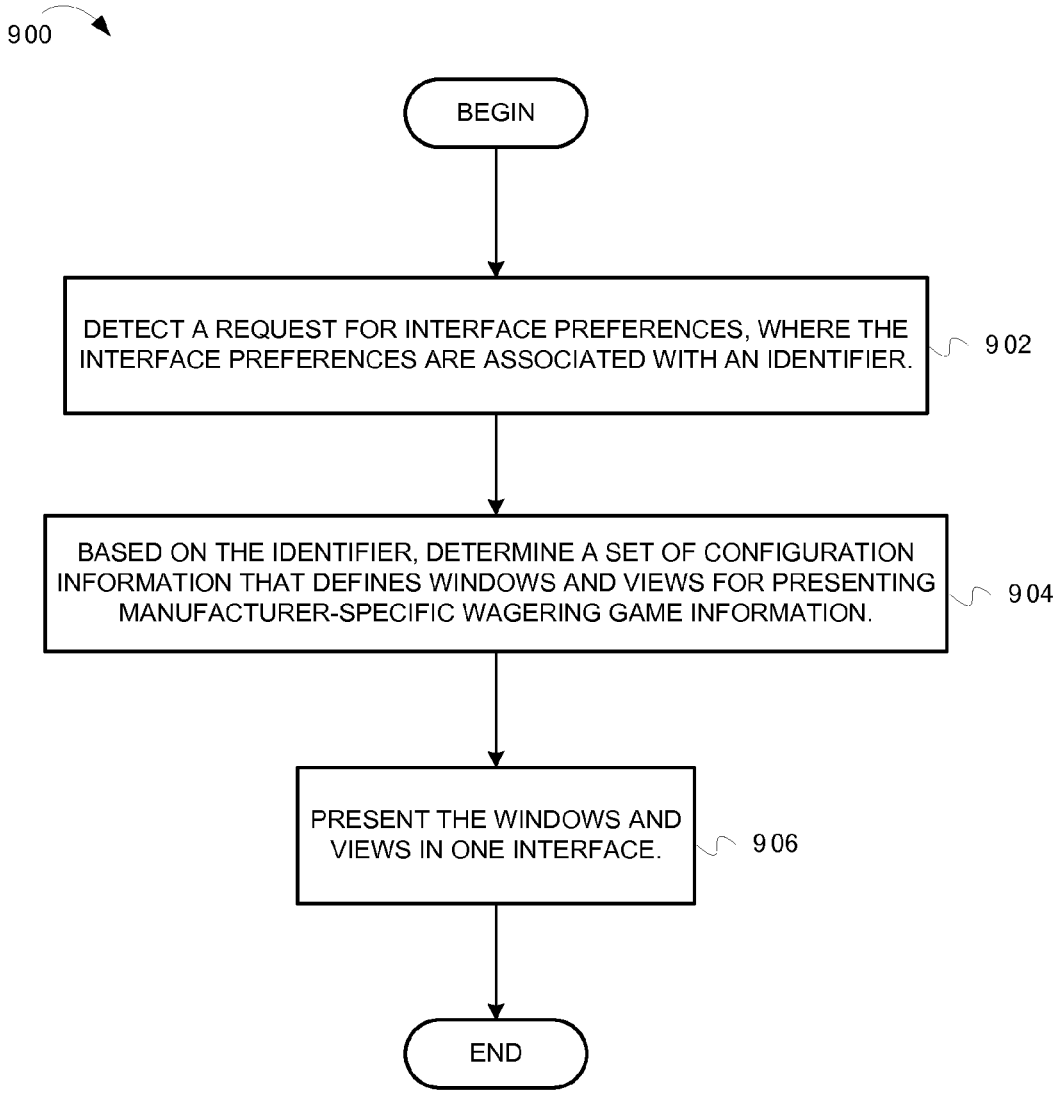
FIG. 9 is a flow diagram illustrating operations for configuring a multi-system manager interface using stored user preferences, according to example embodiments of the invention.

After the multi-system manager's interface has been configured, embodiments of the multi-system manager can later retrieve the configuration selections when users access the manager. FIG. 9 describes this in more detail.

FIG. 9 is a flow diagram illustrating operations for configuring a multi-system manager interface using stored user preferences, according to example embodiments of the invention. The flow 900 begins at block 902.

At block 902, the multi-system manager's user interface controller 306 detects a request for interface preferences, where the interface preferences are associated with an identifier. The user interface controller 306 can receive the request through an interface similar to that shown in FIGS. 6A, 6B, & 7. The identifier can be a user identifier, username, or the like. The flow continues at block 904.

At block 904, the user interface controller 306 determines, based on the identifier, a set of configuration information that defines windows and views for presenting manufacturer-specific wagering game information. In some embodiments, the configuration information is based on option selections stored in the user information store 304. The flow continues at block 906.

At block 906, the user interface controller 306 presents the windows and views in an interface (i.e., the multi-system manager's interface).

While FIGS. 8 and 9 describe operations for configuring and retrieving interface preferences, this section continues with a discussion of other features. In some embodiments, the multi-system manager can consolidate information collected from different wagering game managers and/or wagering game machines.

Figure 10:
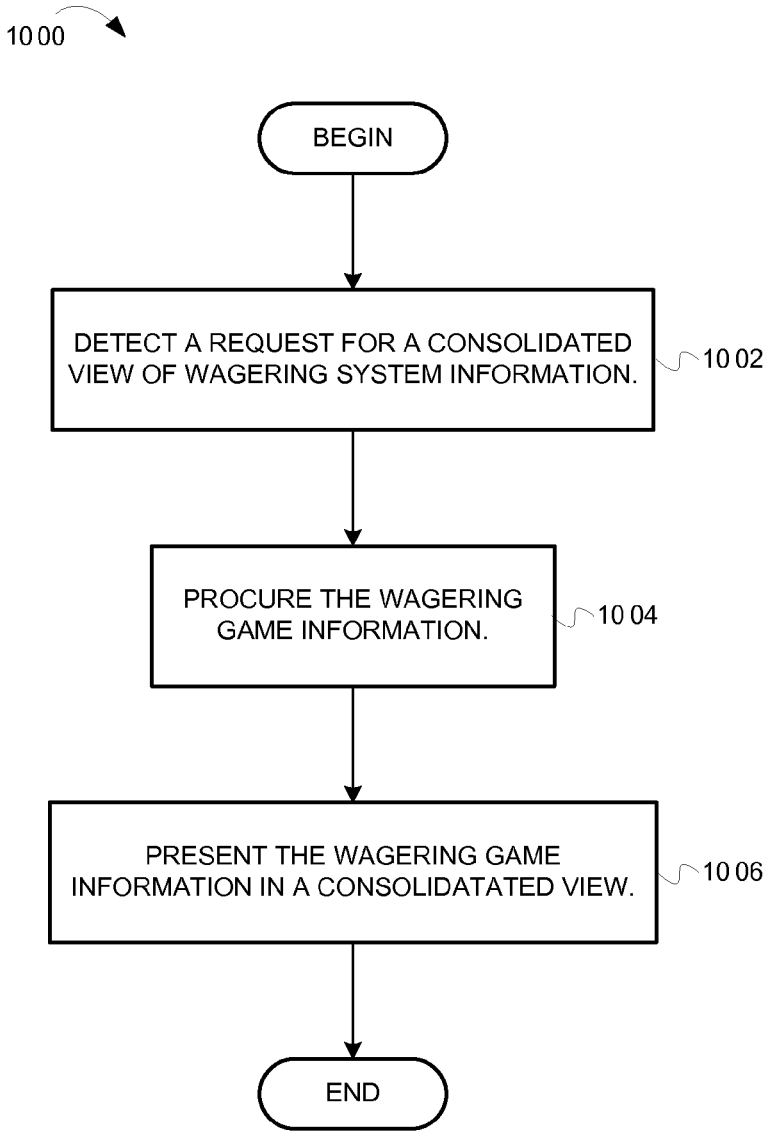
FIG. 10 is a flow diagram illustrating operations for consolidating wagering game information, according to example embodiments of the invention.

FIG. 10 is a flow diagram illustrating operations for consolidating wagering game information, according to example embodiments of the invention. The flow 1000 begins at block 1002.

At block 1002, the multi-system manager's wagering game information controller 308 detects a request for a consolidated view of wagering game information. In some embodiments, the consolidated view can present wagering game information about wagering game machines associated with a selected set of wagering game managers. For example, a consolidated view could present fault information collected from the three wagering game managers 218, 220, & 222. The flow continues at block 1004.

At block 1004, the wagering game information controller 308 procures the wagering game information. In some embodiments, the wagering game information controller 308 can request the information from the wagering game managers 218, 220, & 222 through an application programming interface. Alternatively, the wagering game information controller 308 can collect the wagering game information by monitoring the wagering game managers' resources. For example, the wagering game information controller 308 can acquire the needed information by searching memory associated with the managers 218, 220, & 222, listening to ports associated with the managers 218, 220, & 222, etc. The flow continues at block 1006.

At block 1006, the wagering game information controller 308 presents the wagering game information in a consolidated view. In some embodiments, the consolidated view includes a single chart, table, graph, etc. that represents manufacturer-specific wagering game information collected from different wagering game managers. For example, a consolidated fault view can include Acme-specific information, Golden-Ace-specific information, and Big-Green-specific information. In some embodiments, the consolidated view can include any type of information collected from the wagering game machines 202 and/or the wagering game managers 218, 220, & 222. From block 1006, the flow ends.

Figure 11A:
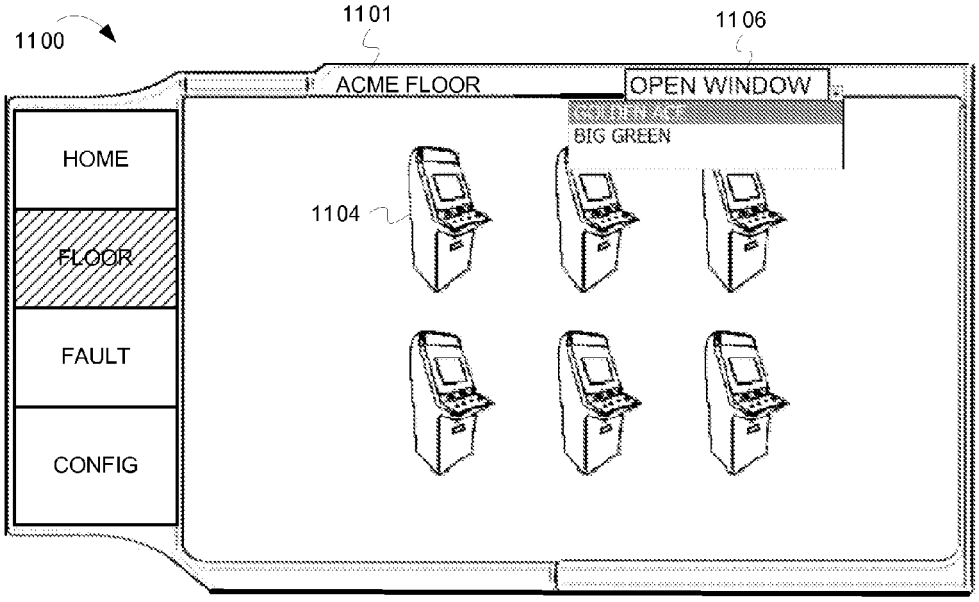
FIG. 11A is a diagram illustrating a multi-system manager capable opening new windows for providing access to different manufacturer-specific and/or nonstandard wagering game features, according to example embodiments of the invention.
Figure 11B:
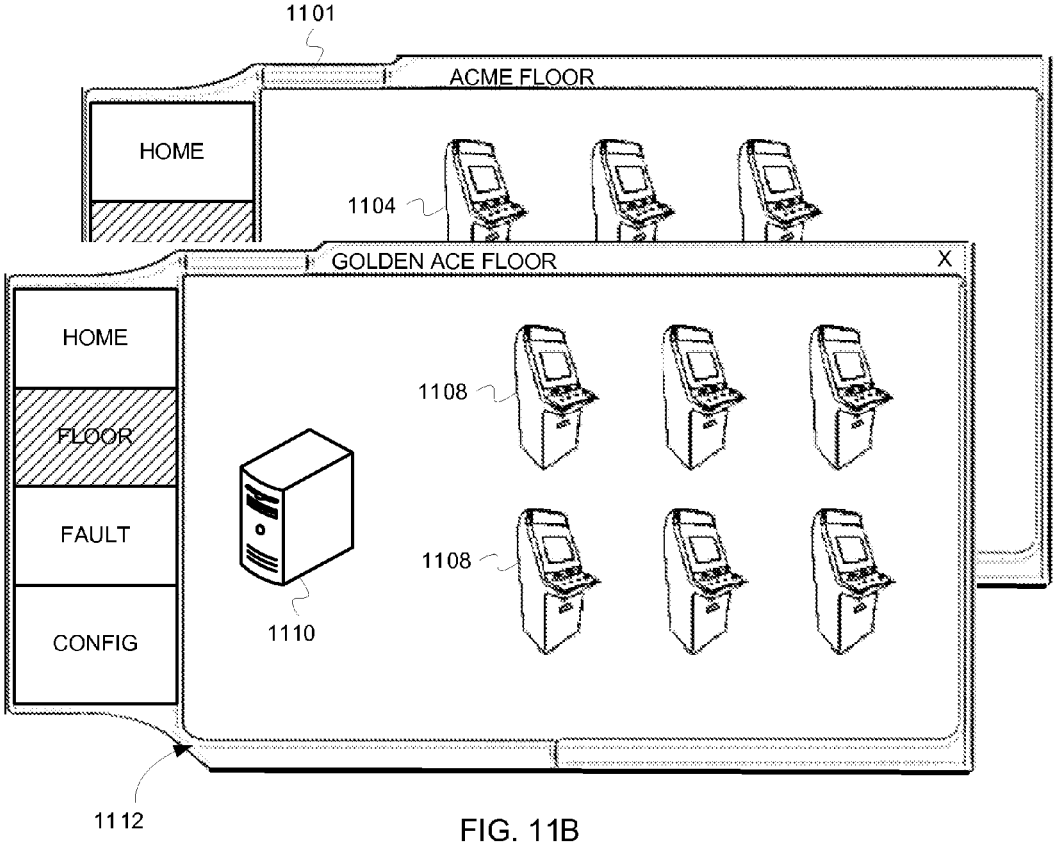
FIG. 11B is a diagram illustrating a wagering game manager opening a window for providing access to manufacturer-specific wagering game features, according to example embodiments of the invention.

This section continues with additional features of some embodiments of the invention. In some embodiments, wagering game managers themselves (i.e., without using a multi-system manager) can access manufacturer-specific/nonstandard information from other wagering game managers. FIGS. 11A and 11B describe embodiments in which a wagering game manager provides access to manufacturer-specific/nonstandard information that it does not typically support.

FIG. 11A is a diagram illustrating a wagering game manager capable of accessing and presenting different manufacturer-specific and/or nonstandard wagering game features, according to example embodiments of the invention. In FIG. 11A, the Acme wagering game manager's interface 1100 includes a window 1101 that can present Acme-specific information about wagering game machines in the casino 212. In one embodiment, the Acme wagering game manager 218 can acquire the Acme-specific information from Acme wagering game machines (i.e., some of the machines 202).

The interface 1100 includes a window menu 1106, which enables users to open new windows for accessing manufacturer-specific features associated with other manufacturers (e.g., Golden Ace). After receiving a selection through the window menu 1106, the Acme wagering game manager 218 can acquire access to manufacturer-specific and/or nonstandard features via the selected manager (e.g., the Golden Ace wagering game manager 222). Then, the selected manager can create a new window in which it can provide access to manufacturer-specific features associated with the selected manager. The features can include manufacturer-specific wagering game information. FIG. 11B shows the interface 1100 after an administrator has selected the "Golden Ace" option in the window menu 1106.

FIG. 11B is a diagram illustrating a wagering game manager opening a window for providing access to manufacturer-specific wagering game features associated with another wagering game manager, according to example embodiments of the invention. In FIG. 11B, the Acme wagering game manager 218 has created a second window 1112 to enable administrators to monitor and/or configure manufacturer-specific features that are different than those accessible in the window 1101. For example, the window 1112 enables administrators to configure and/or monitor Golden-Ace-specific features associated with Golden Ace wagering game machines. After accessing the Golden-Ace-specific features, users can close the window 1112. As a result, in some embodiments, the wagering game managers can provide a "short cut" to the needed nonstandard features, reducing the amount of user effort needed to launch another wagering game manager. In some embodiments, opening the second window 1112 can cause one wagering game manager to launch a scaled-down version of another wagering game manager. In some embodiments, one wagering game manager can access the needed features through calls to an application programming interface associated with another manager.

In some embodiments, there are yet other ways that wagering game managers access/configure information in different manufacturers' machines. Some wagering game managers can use standardized protocols (e.g., the G2S protocol) to access/configure information on wagering game machines made by different manufacturers. For example, in FIG. 1, the Acme wagering game manager 102 could use G2S to access/configure information on any of the wagering game machines 124, 126, & 128. However, there may be some manufacturer-specific/nonstandard information that remains inaccessible, even when the wagering game manager uses G2S or other protocols. In order to access/configure the remaining nonstandard information, wagering game managers can include any of the logic and functionality associated with embodiments of the multi-system manager.

Wagering Game Machines

Figure 12:
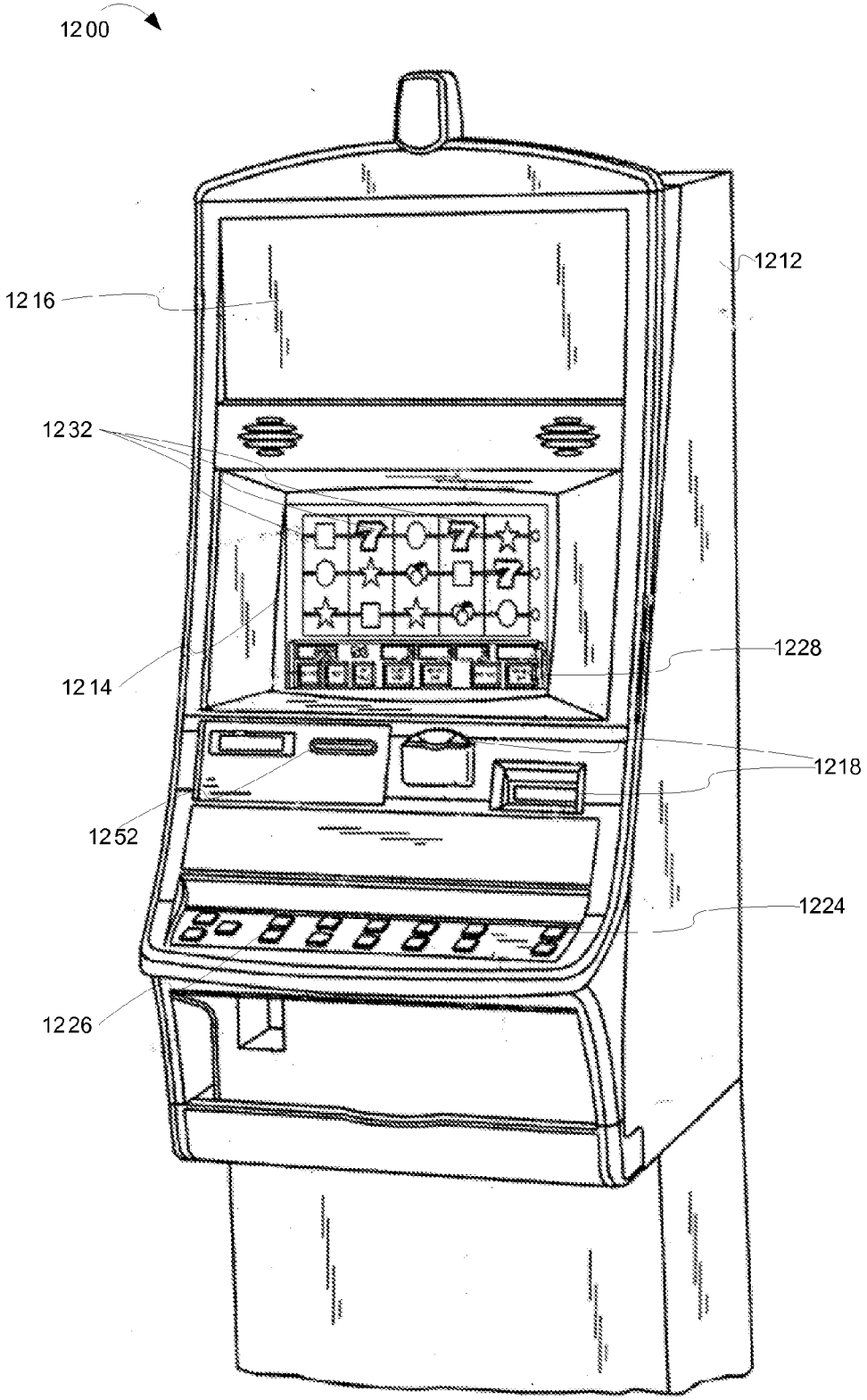
FIG. 12 is a perspective view of a wagering game machine, according to example embodiments of the invention.

FIG. 12 is a perspective view of a wagering game machine, according to example embodiments of the invention. Referring to FIG. 12, a wagering game machine 1200 is used in gaming establishments, such as casinos. According to embodiments, the wagering game machine 1200 can be any type of wagering game machine and can have varying structures and methods of operation. For example, the wagering game machine 1200 can be an electromechanical wagering game machine configured to play mechanical slots, or it can be an electronic wagering game machine configured to play video casino games, such as blackjack, slots, keno, poker, blackjack, roulette, etc.

The wagering game machine 1200 comprises a housing 1212 and includes input devices, including value input devices 1218 and a player input device 1224. For output, the wagering game machine 1200 includes a primary display 1214 for displaying information about a basic wagering game. The primary display 1214 can also display information about a bonus wagering game and a progressive wagering game. The wagering game machine 1200 also includes a secondary display 1216 for displaying wagering game events, wagering game outcomes, and/or signage information. While some components of the wagering game machine 1200 are described herein, numerous other elements can exist and can be used in any number or combination to create varying forms of the wagering game machine 1200.

The value input devices 1218 can take any suitable form and can be located on the front of the housing 1212. The value input devices 1218 can receive currency and/or credits inserted by a player. The value input devices 1218 can include coin acceptors for receiving coin currency and bill acceptors for receiving paper currency. Furthermore, the value input devices 1218 can include ticket readers or barcode scanners for reading information stored on vouchers, cards, or other tangible portable storage devices. The vouchers or cards can authorize access to central accounts, which can transfer money to the wagering game machine 1200.

The player input device 1224 comprises a plurality of push buttons on a button panel 1226 for operating the wagering game machine 1200. In addition, or alternatively, the player input device 1224 can comprise a touch screen 1228 mounted over the primary display 1214 and/or secondary display 1216.

The various components of the wagering game machine 1200 can be connected directly to, or contained within, the housing 1212. Alternatively, some of the wagering game machine's components can be located outside of the housing 1212, while being communicatively coupled with the wagering game machine 1200 using any suitable wired or wireless communication technology.

The operation of the basic wagering game can be displayed to the player on the primary display 1214. The primary display 1214 can also display a bonus game associated with the basic wagering game. The primary display 1214 can include a cathode ray tube (CRT), a high resolution liquid crystal display (LCD), a plasma display, light emitting diodes (LEDs), or any other type of display suitable for use in the wagering game machine 1200. Alternatively, the primary display 1214 can include a number of mechanical reels to display the outcome. In FIG. 12, the wagering game machine 1200 is an "upright" version in which the primary display 1214 is oriented vertically relative to the player. Alternatively, the wagering game machine can be a "slant-top" version in which the primary display 1214 is slanted at about a thirty-degree angle toward the player of the wagering game machine 1200. In yet another embodiment, the wagering game machine 1200 can exhibit any suitable form factor, such as a free standing model, bartop model, mobile handheld model, or workstation console model.

A player begins playing a basic wagering game by making a wager via the value input device 1218. The player can initiate play by using the player input device's buttons or touch screen 1228. The basic game can include arranging a plurality of symbols along a payline 1232, which indicates one or more outcomes of the basic game. Such outcomes can be randomly selected in response to player input. At least one of the outcomes, which can include any variation or combination of symbols, can trigger a bonus game.

In some embodiments, the wagering game machine 1200 can also include an information reader 1252, which can include a card reader, ticket reader, bar code scanner, RFID transceiver, or computer readable storage medium interface. In some embodiments, the information reader 1252 can be used to award complimentary services, restore game assets, track player habits, etc.

General

In the detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

presenting, on a display device of a computer system, a list of available wagering game managers including a first wagering game manager and a second wagering game manager, wherein the first wagering game manager is configured to access first manufacturer-specific parameters specific to first wagering game machines of a first manufacturer, wherein the second wagering game manager is configured to access second manufacturer-specific parameters specific to second wagering game machines of a second manufacturer, wherein at least one of the first manufacturer-specific parameters is different from the second manufacture-specific parameters;

detecting, via a user input device of the computer system, that the first and second wagering game managers have been selected from the list;

launching, in a memory device via at least one processor, a multi-system manager, the first wagering game manager, and the second wagering game manager;

determining, by the first wagering game manager, first values for the first manufacturer-specific parameters;

determining, by the second wagering game manager, second values for the second manufacturer-specific parameters;

determining, by the multi-system manager, third values for standard parameters of the first and second wagering game machines;

presenting, on the display device by multi-system manager, an interface including a first view showing the first manufacturer-specific values, a second view showing the second manufacturer-specific values, and a third view showing the third values for the standard parameters.

2. The method of claim 1 further comprising:

receiving, via the first view presented by the multi-system manager, first user input indicating a first configuration to be made to the first wagering game machines;

receiving, via the second view presented by the multi-system manager, second user input indicating a second configuration to be made to the second wagering game machines;

configuring, by the first and second wagering game managers, the first and second wagering game machines according to the first and second configurations.

3. The method of claim 1 further comprising:

receiving, by the multi-system manager via the user input device, a request to present, in a custom view in the interface, additional parameters specific to the first wagering game machines;

storing information defining the custom view and the addition parameters;

determining values for the additional manufacturer-specific parameters specific to the first wagering game machines; and presenting, via the multi-system manager via the custom view, the additional manufacturer-specific parameters specific to the first wagering game machines.

4. The method of claim 1 further comprising:

receiving, via the first view presented by the multi-system manager, first user input indicating a first configuration to be made to the first wagering game machines.

5. The method of claim 1, wherein the first wagering game manager is not capable of accessing the second manufacturer-specific parameters specific to the second wagering game machines.

6. The method of claim 1, wherein the second wagering game manager is not capable of accessing the first manufacturer-specific parameters specific to the first wagering game machines.

7. The method of claim 1, wherein the first manufacturer-specific parameters are specific to the first manufacturer and are not accessible to the second wagering game manager.

8. An apparatus comprising:

one or more processors;

one or more non-transitory machine readable storage devices including computer executable program code executable on the one or more processors, the program code including program code to present, on a display device of a computer system, a list of available wagering game managers including a first wagering game manager and a second wagering game manager, wherein the first wagering game manager is configured to access first manufacturer-specific parameters specific to first wagering game machines of a first manufacturer, and wherein the second wagering game manager is configured to access second manufacturer-specific parameters specific to second wagering game machines of a second manufacturer, wherein at least one of the first manufacturer-specific parameters is different from the second manufacture-specific parameters;

program code to detect, via a user input device of the computer system, that the first and second wagering game managers have been selected from the list;

program code to launch, in a memory device via at least one processor, a multi-system manager, the first wagering game manager, and the second wagering game manager;

program code to determine, by the first wagering game manager, first values for the first manufacturer-specific parameters;

program code to determine, by the second wagering game manager, second values for the second manufacturer-specific parameters;

program code to determine, by the multi-system manager, third values for standard parameters of the first and second wagering game machines;

program code to present, on the display device by multi-system manager, an interface including a first view showing the first values for the first manufacturer-specific parameters, a second view showing the second values for the second manufacturer-specific parameters, and a third view showing the third values for the standard parameters.

9. The apparatus of claim 8, wherein the program code further includes:

program code to receive, via the first view presented by the multi-system manager, first user input indicating a first configuration to be made to the first wagering game machines;

program code to receive, via the second view presented by the multi-system manager, second user input indicating a second configuration to be made to the second wagering game machines;

program code to configure, by the first and second wagering game managers, the first and second wagering game machines according to the first and second configurations.

10. The apparatus of claim 8, wherein the program code further includes:

program code to receive, by the multi-system manager via the user input device, a request to present, in a custom view in the interface, additional manufacturer-specific parameters specific to the first wagering game machines;

program code to store information defining the custom view and the additional manufacturer-specific parameters;

program code to determine values for the additional manufacturer-specific parameters specific to the first wagering game machines; and program code to present, via the multi-system manager via the custom view, the additional manufacturer-specific parameters specific to the first wagering game machines.

11. The apparatus of claim 8, wherein the first wagering game manager is not capable of accessing the second manufacturer-specific parameters specific to the second wagering game machines.

12. The apparatus of claim 8, wherein the second wagering game manager is not capable of accessing the first manufacturer-specific parameters specific to the first wagering game machines.

13. The apparatus of claim 8, wherein the first manufacturer-specific parameters are specific to the first manufacturer and are not accessible to the second wagering game manager.

14. One or more non-transitory machine readable storage devices including computer executable program code executable on one or more processors, the program code including:

program code to present, on a display device of a computer system, a list of available wagering game managers including a first wagering game manager and a second wagering game manager, wherein the first wagering game manager is configured to access first manufacturer-specific parameters specific to first wagering game machines of a first manufacturer, and wherein the second wagering game manager is configured to access second manufacture-specific parameters specific to second wagering game machines of a second manufacturer, wherein at least one of the first manufacturer-specific parameters is different from the second manufacture-specific parameters;

program code to detect, via a user input device of the computer system, that the first and second wagering game managers have been selected from the list;

program code to launch, in a memory device via at least one processor, a multi-system manager, the first wagering game manager, and the second wagering game manager;

program code to determine, by the first wagering game manager, first manufacturer-specific values for the first manufacturer-specific parameters;

program code to determine, by the second wagering game manager, second manufacturer-specific values for the second manufacturer-specific parameters;

program code to determine, by the multi-system manager, third values for standard parameters of the first and second wagering game machines;

program code to present, on the display device by multi-system manager, an interface including a first view showing the first manufacturer-specific values, a second view showing the second manufacturer-specific values, and a third view showing the third values for the standard parameters.

15. The non-transitory storage device of claim 14, wherein the program code further includes:

program code to receive, via the first view presented by the multi-system manager, first user input indicating a first configuration to be made to the first wagering game machines;

program code to receive, via the second view presented by the multi-system manager, second user input indicating a second configuration to be made to the second wagering game machines;

program code to configure, by the first and second wagering game managers, the first and second wagering game machines according to the first and second configurations.

16. The non-transitory storage device of claim 14, wherein the program code further includes:

program code to receive, by the multi-system manager via the user input device, a request to present, in a custom view in the interface, additional manufacturer-specific parameters specific to the first wagering game machines;

program code to store information defining the custom view and the addition manufacturer-specific parameters;

program code to determine values for the additional manufacturer-specific parameters specific to the first wagering game machines; and program code to present, via the multi-system manager via the custom view, the additional manufacturer-specific parameters.

17. The non-transitory storage device of claim 14, wherein the first wagering game manager is not capable of accessing the second manufacturer-specific parameters specific to the second wagering game machines.

18. The non-transitory storage device of claim 14, wherein the second wagering game manager is not capable of accessing the first manufacturer-specific parameters specific to the first wagering game machines.

19. The non-transitory storage device of claim 14, wherein the first manufacturer-specific parameters are specific to a first manufacturer and are not accessible to the second wagering game manager.

* * * * *